US010480507B2

(12) United States Patent
McGowan et al.

(10) Patent No.: US 10,480,507 B2
(45) Date of Patent: Nov. 19, 2019

(54) GEROTOR ASSEMBLY HAVING AN OIL GROOVE

(71) Applicant: GM GLOBAL TECHNOLOGY OPERATIONS LLC, Detroit, MI (US)

(72) Inventors: Sean M McGowan, Northville, MI (US); Joel H Pike, Haslett, MI (US); John B Davis, Hartland, MI (US); Bryan K Pryor, Waterford, MI (US); Mark R Claywell, Birmingham, MI (US); Jeremy T Demarest, Waterford, MI (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 254 days.

(21) Appl. No.: 15/254,284

(22) Filed: Sep. 1, 2016

(65) Prior Publication Data

US 2018/0058450 A1 Mar. 1, 2018

(51) Int. Cl.

| | |
|---|---|
| ***F03C 2/00*** | (2006.01) |
| ***F03C 4/00*** | (2006.01) |
| ***F04C 18/00*** | (2006.01) |
| ***F04C 2/00*** | (2006.01) |
| ***F04C 15/00*** | (2006.01) |

(Continued)

(52) U.S. Cl.

CPC ..... *F04C 15/0088* (2013.01); *F01M 1/02* (2013.01); *F04C 2/084* (2013.01); *F04C 2/088* (2013.01); *F04C 2/102* (2013.01); *F01M 2001/0238* (2013.01); *F04C 2210/206* (2013.01); *F04C 2240/20* (2013.01); *F04C 2240/30* (2013.01);

(Continued)

(58) Field of Classification Search

CPC ..... F04C 2/102; F04C 15/0088; F04C 2210/206; F04C 2240/30; F04C 2240/20; F04C 2240/60; F01M 1/02; F01M 2001/0238

USPC ..... 418/61.3, 88, 140, 144, 166, 171, 186

See application file for complete search history.

(56) References Cited

U.S. PATENT DOCUMENTS 5,085,187 A * 2/1992 Black ..... F04C 2/102 418/171

5,501,585 A 3/1996 Ogawa (Continued)

FOREIGN PATENT DOCUMENTS

JP 02075783 A * 3/1990 ..... F04C 2/102

JP 2008297999 A 12/2008

JP 2010190161 A * 9/2010 ..... F04C 2/102

OTHER PUBLICATIONS

JP2008297999A—Ono, Yasunori et al.—Internal Gear Pump—Dec. 11, 2008—English Translation (Year: 2008).*

(Continued)

*Primary Examiner* — Theresa Trieu

(74) *Attorney, Agent, or Firm* — Cantor Colburn LLP

(57) ABSTRACT

A gerotor assembly is provided which includes a crankshaft, an inner drive gear, an outer driven gear and a housing defining an oil groove. The inner drive gear defines a plurality of inner gear teeth. The outer driven gear defines a plurality of outer gear teeth operatively configured to engage with the inner gear teeth. The outer drive gear may define a plurality of passageways to form a hydrodynamic film between the outer driven gear and the housing. Alternatively, a high pressure oil pump may feed oil into the oil groove in order to distribute a hydrodynamic film.

14 Claims, 8 Drawing Sheets

(51) Int. Cl.

| | |
|---|---|
| ***F01M 1/02*** | (2006.01) |
| ***F04C 2/10*** | (2006.01) |
| ***F04C 2/08*** | (2006.01) |

(52) U.S. Cl.
CPC ..... *F04C 2240/54* (2013.01); *F04C 2240/60* (2013.01)

(56) References Cited

U.S. PATENT DOCUMENTS

| | | | | |
|---|---|---|---|---|
| 6,276,910 | B1 | 8/2001 | Tsukamoto | |
| 6,974,315 | B2 | 12/2005 | Dees | |
| 2003/0215345 | A1* | 11/2003 | Holtzapple | F04C 2/102 418/171 |
| 2004/0161355 | A1 | 8/2004 | Dees | |
| 2004/0234393 | A1 | 11/2004 | Kim | |
| 2015/0285301 | A1 | 10/2015 | Begin et al. | |
| 2016/0025158 | A1 | 1/2016 | Kobayashi et al. | |

OTHER PUBLICATIONS

Stelmahk et al., Reduction of friction and wear by grooves applied on the nonoscale polished surface in boundary lubrications conditions, Nanoscale Research Letters 2014 9:226.

Design of Shafts and Housings, NSK, A100.

Russo, Michael. "Oil Groves for Bronze Bushing." www.nationalbronze.com. National Bronze Michigan, Jul. 29, 2013. Web. Aug. 2, 2016. <http%3A%2F%2Fwww.nationalbronze.com%2FNews%2F410%2F>.

Royal Enfield USA—Official Website. Retrieved Aug. 3, 2016, from http://royalenfield.com/community/forum/thread/posts/?topicid=3050.

Grumpyvette. "Causes of Bearing Failure." Grumpys Performance Garage. Jan. 12, 2010 Web. Aug. 16, 2016. <http://garage.grumpysperformance.com/index.php?threads%2F454-bbc-on-the-cheap-well-to-start.11739%2F>.

* cited by examiner

GEROTOR ASSEMBLY HAVING AN OIL GROOVE

TECHNICAL FIELD

The present disclosure concerns engine components, and more particularly, a gerotor gear assembly for the engine oil pump.

BACKGROUND

An oil pump for an engine used in a vehicle includes a rotor that revolves and an oil pump housing that encases the rotor. The rotor and oil pump housing are generally formed from material such as iron (cast iron), billet steel, powdered metal, aluminum, or the like.

In conventional oil pumps, an inner drive gear is typically formed with one less gear-tooth than an outer driven gear. When the inner drive gear and the outer driven gear engage each other and spin, the inner drive gear rotates one gear-tooth faster than the outer driven gear per cycle. During the execution of a single complete cycle or revolution of the drive gear, a cavity is formed between each of the drive gear-teeth and the driven gear-teeth. The cavity gradually and consecutively expands on the intake side and contracts on the exhaust side as the drive gear and driven gear rotate.

The typical oil pump also includes a housing that has an oil intake port, an oil exhaust port, and an isolated housing portion. Theoretically, oil is taken up between teeth of the drive gear and driven gear and compressed into a cavity between these teeth. Initially the cavity is in an expanding state, the cavity between each of the drive gear teeth and the driven gear teeth then contracts as the gears rotate and discharge the oil into the oil discharge port. Thus, the oil is taken in from the oil intake port, compressed between the teeth of the drive gear and driven gear and delivered to the oil discharge port.

Typically, the end portion of the oil intake groove and the start portion of the oil exhaust groove are configured to be separated from one another. An isolated housing portion may disposed between the oil intake and oil discharge ports in order to separate the oil intake port and oil discharge port. A drawback in the typical oil pump design is that the exterior surface of the outer drive gear and the inner surface of the housing unit experiences wear and friction at that interface due to the various loads experienced between the outer driven gear and the housing. The aforementioned condition lowers the durability of the housing and increasing oil leakage through clearance between the meshing gear-teeth.

SUMMARY

The present disclosure provides a gerotor assembly having a crankshaft, an inner drive gear, an outer driven gear and a housing. The housing defines an oil groove on the interior surface of the housing where the oil groove is in communication with a port. The inner drive gear defines a plurality of inner gear teeth. The inner drive gear may be engaged or mounted onto a crankshaft. The outer driven gear defines a plurality of outer gear teeth operatively configured to engage with the inner gear teeth. As the gears rotate relative to one another, the outer driven gear and the inner drive gear define a compressible cavity therebetween.

A gerotor assembly is also provided having a crankshaft, an inner driven gear, an outer driven gear defining passageways, and a housing defining an oil groove. The passageways are operatively configured to transfer scavenge oil from at least one cavity between the inner drive gear and the outer driven gear to the oil groove which then distributes oil to form a hydrodynamic film between the outer driven gear and the housing. The passageways may each terminate in a mini-groove at an outer side of the outer driven gear.

A gerotor assembly is also provided having a crankshaft, an inner drive gear, an outer driven gear, a housing defining an oil groove, a high pressure pump, and a high pressure oil passage defined in the housing and operatively configured to provide fluid communication between the oil groove and the high pressure pump. The high pressure oil passage may be operatively configured to feed high pressure oil from a high pressure pump into the oil groove. Similarly, the oil groove then distributes oil to form a hydrodynamic film between the outer driven gear and the housing

BRIEF DESCRIPTION OF THE DRAWINGS

These and other features and advantages of the present disclosure will be apparent from the following detailed description of preferred embodiments, and best mode, appended claims, and accompanying drawings in which:

Like reference numerals refer to like parts throughout the description of several views of the drawings.

DETAILED DESCRIPTION

The exemplary embodiments described herein provide detail for illustrative purposes, and are subject to many variations in composition, structure, and design. It is understood that various omissions and substitutions of equivalents are contemplated as circumstances may suggest or render expedient, but these are intended to cover the application or implementation without departing from the spirit or scope of the claims of the present disclosure. Also, it is to be understood that the phraseology and terminology used herein are for the purpose of description and should not be regarded as limiting.

The terms "first," "second," and the like, herein do not denote any order, quantity, or importance, but rather are used to distinguish one element from another, and the terms "a" and "an" herein do not denote a limitation of quantity, but rather denote the presence of at least one of the referenced items.

Figure 1:
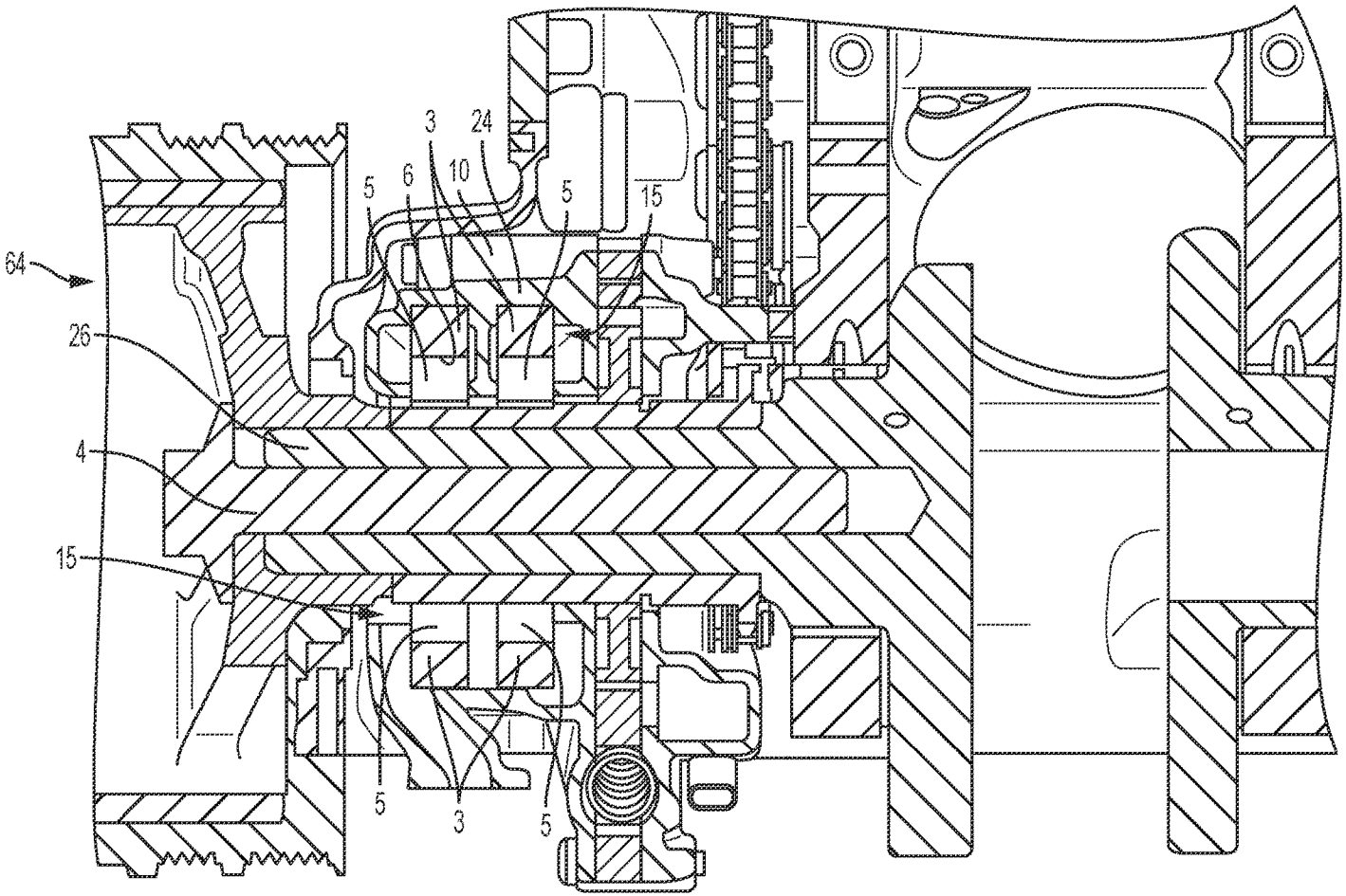
FIG. 1 is a side cross-sectional view of an engine with a gerotor gear set of the present disclosure.

Referring to FIG. 1, a scavenge oil pump 64 which incorporates the gerotor assembly 10 in accordance with various embodiments of the present disclosure is shown. The scavenge oil pump 4 is operatively configured to return oil from the crankcase to the oil tank. In certain engines, the crank nose may relatively long where configured with two scavenge gerotor gear sets 15 such that the bending force of the crank nose is exaggerated causing wear in a traditional gerotor assembly (not shown). Because there are multiple scavenge pumps in the engine, each scavenge pump can run for long periods of time pumping only air and no oil, leading to a lack of lubrication and thus wear between the outer gerotor and the housing. However, it is understood that the gerotor assembly 10 of the present disclosure includes at least one gear set 15 within a housing 24. The gear set 15 includes an inner drive gear 5 and an outer driven gear 3.

Figure 2:
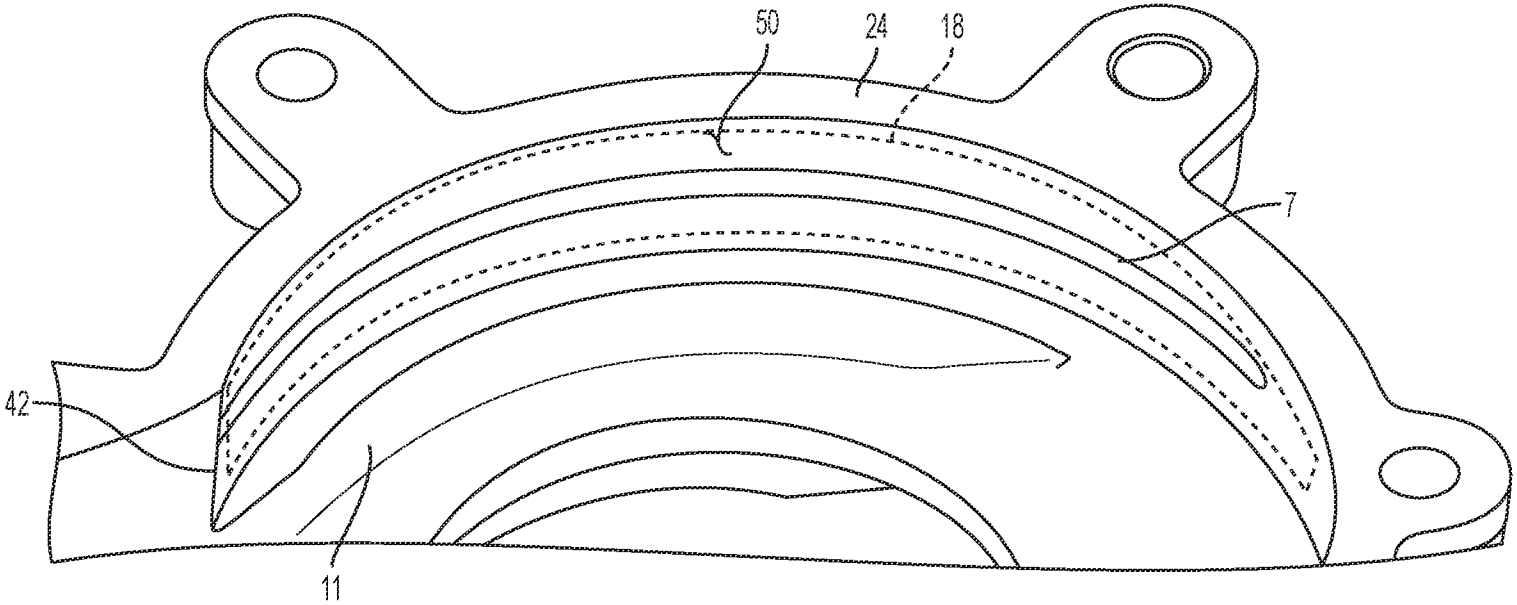
FIG. 2 is an isometric view of a first embodiment of the present disclosure where a gerotor assembly defines an oil groove in the housing.
Figure 4B:
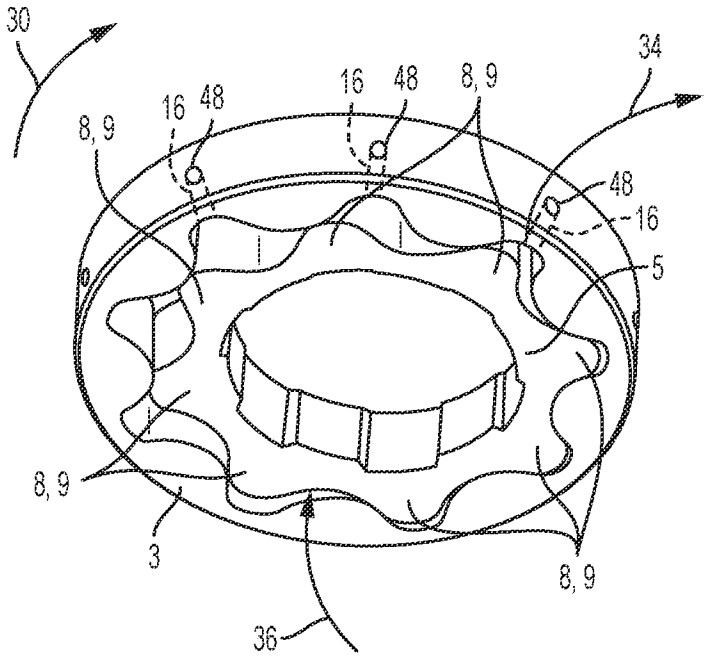
FIG. 4B is an isometric view of inner drive gear and outer driven gear according to the first embodiment of the present disclosure.
Figure 4A:
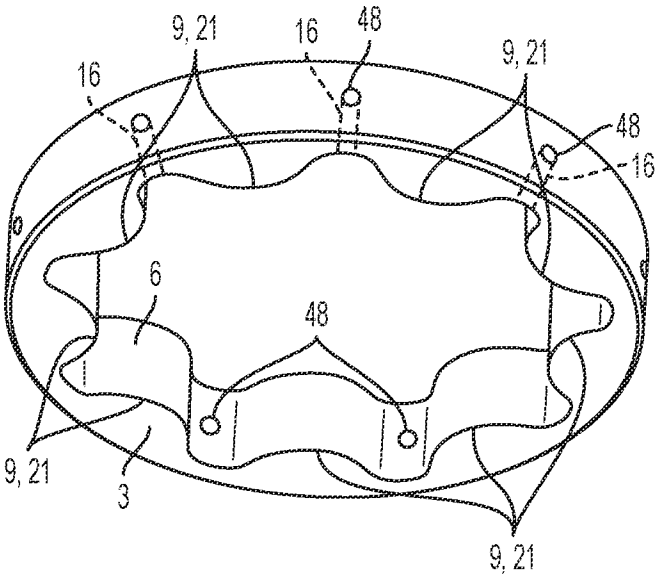
FIG. 4A is an isometric view of an outer gear according to the first embodiment of the present disclosure.

FIG. 2 illustrates a first embodiment of the present disclosure where the inside of the housing 24 is shown and the inner drive gear 5 (shown in FIG. 1) and the outer driven gear 3 (shown in FIG. 1) are removed. An oil groove 7 is shown, while a pump exhaust port 11 is also partially shown. The oil groove 7 is defined in the interior surface 50 of housing 24. The oil groove 7 may be in fluid communication with exhaust port 11 or at least one passageway 16 (as shown in FIG. 4). The oil groove 7 distributes pressurized scavenge oil between the outer driven gear 3 and the housing 24 creating a hydro-dynamic film 18 (shown as phantom element 18) between the outer driven gear 3 and the housing 24. The oil groove 7 may also increase local clearances in the pump 4 thereby providing a thicker oil layer (in the groove) between the outer driven gear 3 and the housing 24. Accordingly, oil shear between the outer driven gear 3 and the housing 24 is reduced and the gerotor assembly 10 experiences less friction. The oil groove 7 may be fed scavenge oil via various means such as, but not limited to edge opening 42 and exhaust port 11, outer gear passageways 16 and cavities 12, 12' (shown in FIGS. 4A-4B and FIG. 5A-5B), or high pressure oil passage 62 and a high pressure oil pump 60 (shown in FIG. 8).

Figure 3:
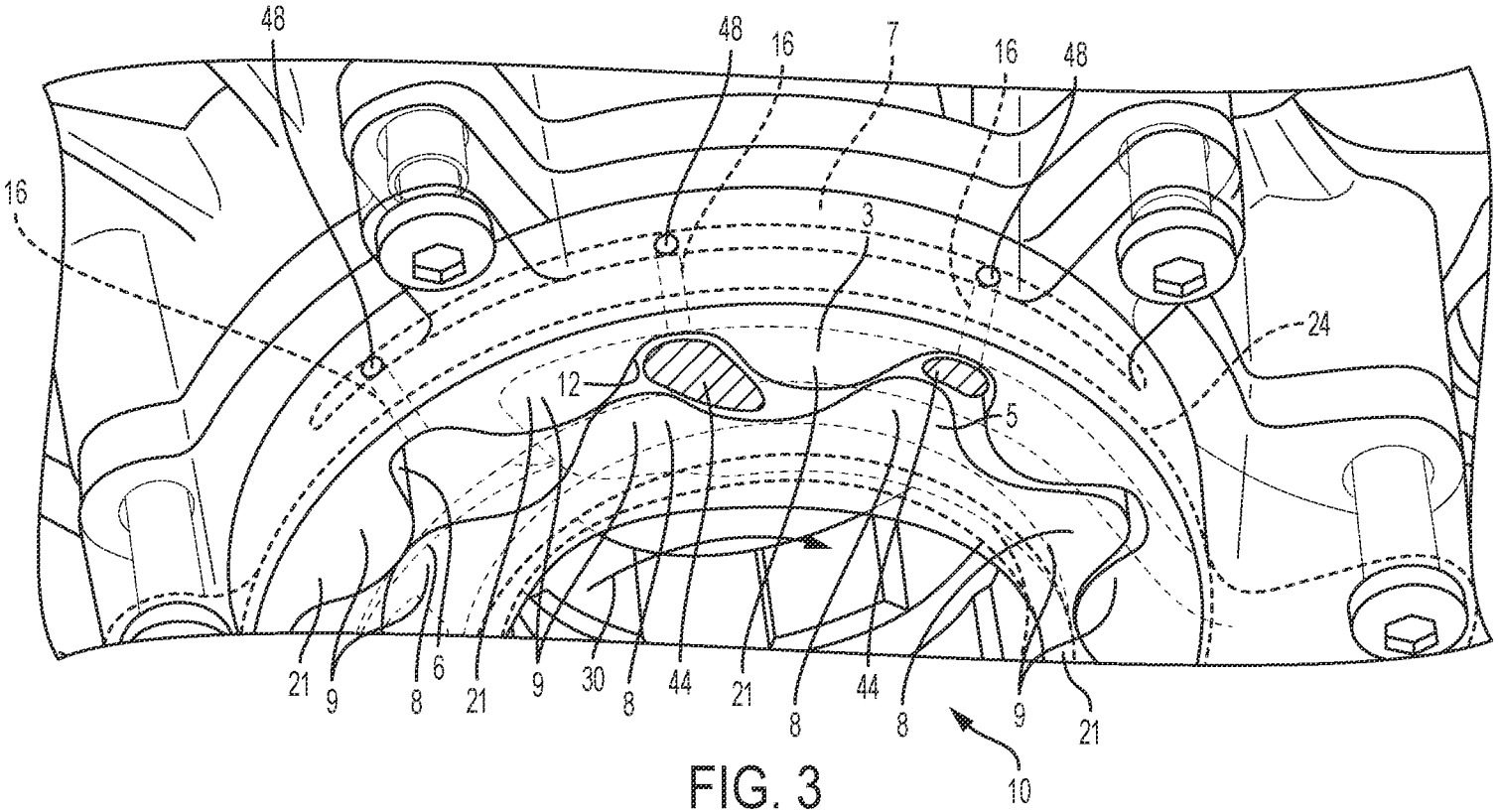
FIG. 3 is a partial perspective view of a first embodiment of the present disclosure where the outer driven gear defines passageways to feed scavenge oil to an oil groove and are in fluid communication with the oil groove.

Referring now to FIG. 3, the first embodiment of the present disclosure is shown where the oil groove 7 is operatively configured to fluidly communicate with at least one passageway 16 in the outer driven gear 3. Each passageway 16 functions as a means upon which a portion of the scavenge oil (schematically shown as 44) in the cavity 12 may be transferred to the oil groove 7 in order to reduce oil shear between the outer driven gear 3 and the housing 24. Accordingly, the first embodiment provides an inner drive gear 5 and an outer driven gear 3 that lubricates the interface between the outer driven gear 3 and the housing 24 at oil groove 7 via a plurality of passageways 16 or at least one passageway 16 defined in the outer driven gear. The passageways 16, may but not necessarily, be radially aligned as shown. The passageways 16 shown in FIGS. 4A and 4B begin at an aperture 48 defined in the inner side 6 of the outer drive gear 3 and may terminate in a corresponding aperture 48 defined in the exterior side 22 of the outer drive gear 3. The hydrodynamic film 18, therefore, improves power efficiency. It is understood that the transfer of the scavenge oil 44 in the passageways 16 occurs when the inner drive gear 5 and the outer driven gear 3 reach a predetermined rotational pressure within the cavity. It is also understood that the oil groove 7 in housing 24 is adjacent to the exterior side 22 of the outer driven gear 3 as shown in FIG. 3.

Referring again to FIG. 3, an outer driven gear 3 is installed inside a housing 24, and an inner drive gear 5 is mounted at an inner side 6 of the outer driven gear 3. The outer driven gear 3 and inner drive gear 5 engage each other via engagement of a portion of inner gear teeth 8 and the outer gear teeth 21 during a clockwise rotation 30. In operation, when the inner drive gear 5 rotates, the outer driven gear 3 correspondingly rotates in a clockwise direction. In reference further to FIG. 3, as the drive gear 5 and driven gear 3 rotate, the drive gear 5 rotates slightly faster than the outer driven gear 3.

Figure 6:
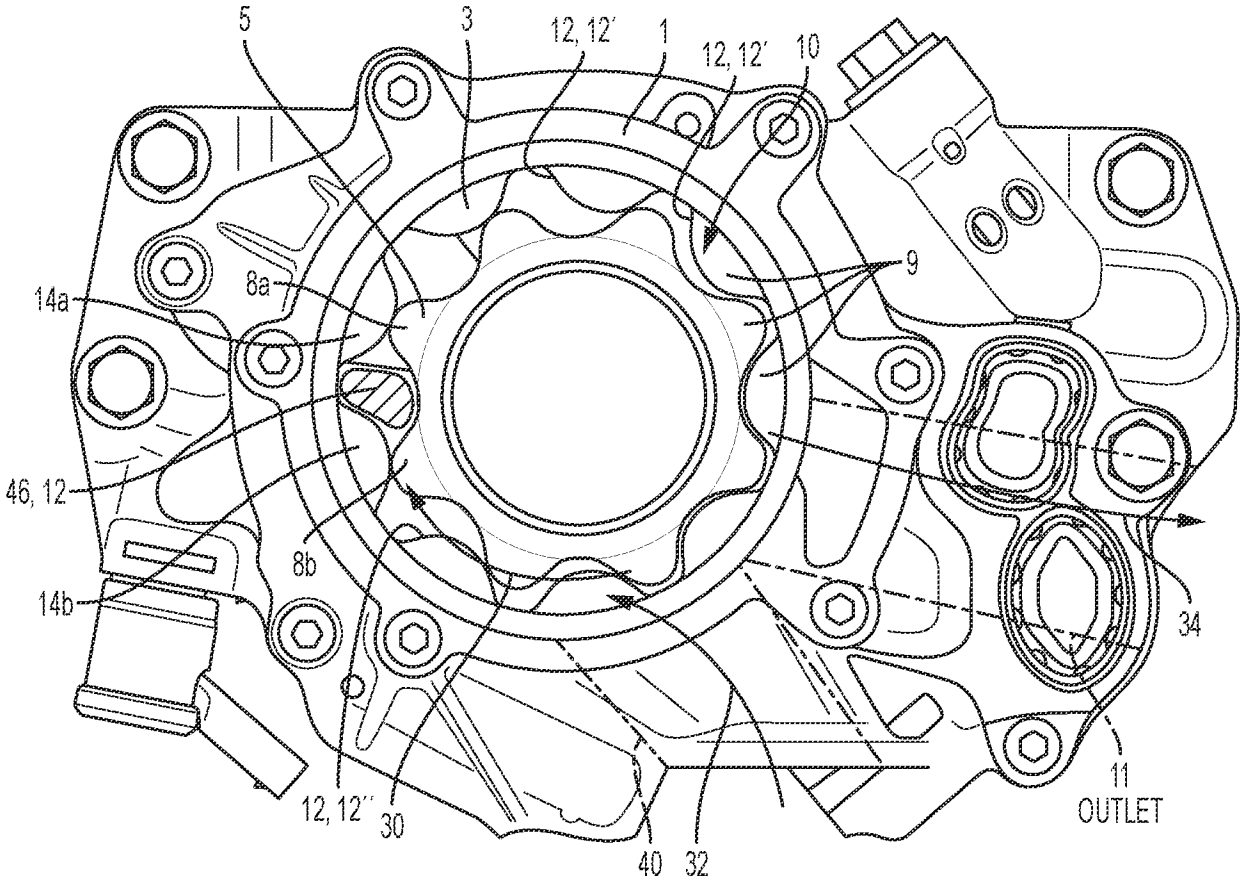
FIG. 6 is a perspective front view of the inner drive gear and outer driven gear in a pump in accordance with various embodiments of the present disclosure.
Figure 7:
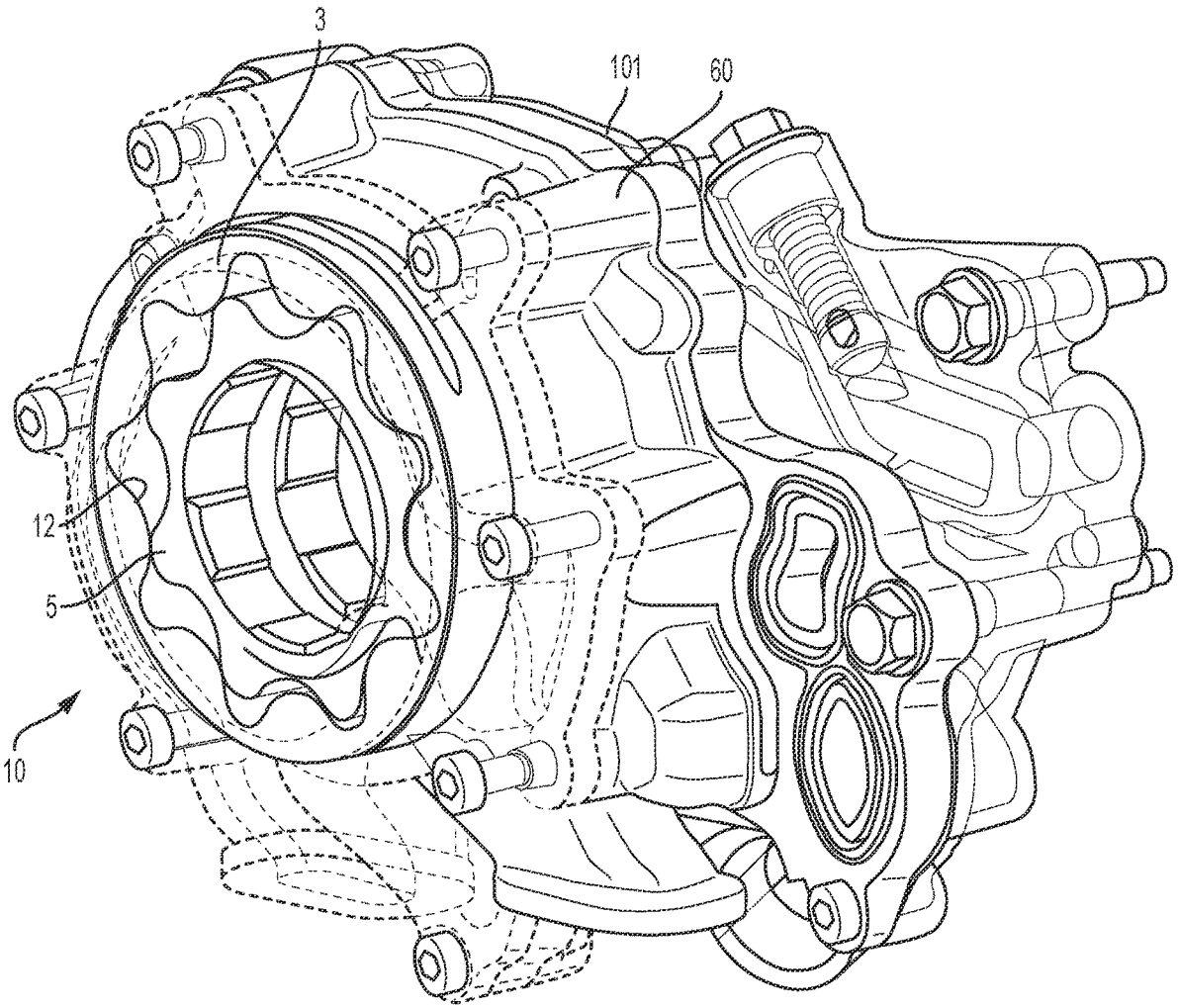
FIG. 7 is a perspective isometric view of the inner drive gear and outer driven gears in a pump in accordance with various embodiments of the present disclosure.

Referring to FIGS. 6-7 and in accordance with various embodiments of the present disclosure, during the rotation of the inner drive gear 5 relative to the outer driven gear 3, two gear-teeth 8*a*, 8*b* of the inner drive gear 5 and two gear-teeth 14*a*, 14*b* of the outer driven gear 3 may be substantially symmetrically placed and a maximum cavity 46 may be formed between the aforementioned gear teeth. At this position, size of the maximum cavity 46 is at a maximum value. As the inner drive gear 5 and outer driven gear 3 spin in the clockwise direction, the outer driven gear 3, the inner drive gear 5, and respective cavity 12, 12', 12" formed there-between change between a compressed state and an expanded state where the cavity size changes as the gears rotate. In the compressible cavity 12', the cavity 12, 12' starts to become compressed as the gears rotate. Therefore, the scavenge oil in the compressible cavity 12, 12' is forced to occupy another space such as the passageways 16 or via exhaust flow 34 to the exhaust port 11. The fluid communication in the passageways 16 increases as the cavity 12' decreases in size. The passageways 16 are shown in outer driven gear 3 in FIGS. 4A and 4B) as the volume of the compressed cavity 12, 12' decreases. In the expanded state, the expanded cavity 12" increases in size thereby creating a vacuum and drawing scavenge oil as intake flow 32 into the cavity 12, 12" via intake port 40.

Referring now to FIGS. 4A and 4B, the inner drive gear 5 and the outer driven gear 3 of the first embodiment of the present disclosure is shown where passageways 16 are defined in the outer driven gear 3 in order feed nominal amounts of scavenge oil from the compressed cavity 12, 12' between the inner and outer gears to the oil groove 7. Accordingly, a hydrodynamic film 18 (shown in FIG. 2) may be created in the oil groove 7 when a predetermined maximum pressure is reached during the rotation of the inner drive gear 5 and outer driven gear 3. Accordingly, in this first embodiment, scavenge oil 44 flows from the compressed cavities 12, 12' to the passageways 16 and then forming a hydrodynamic film 18 (shown in FIG. 2) with the excess flowing out to the pump outlet 11.

Figure 5B:
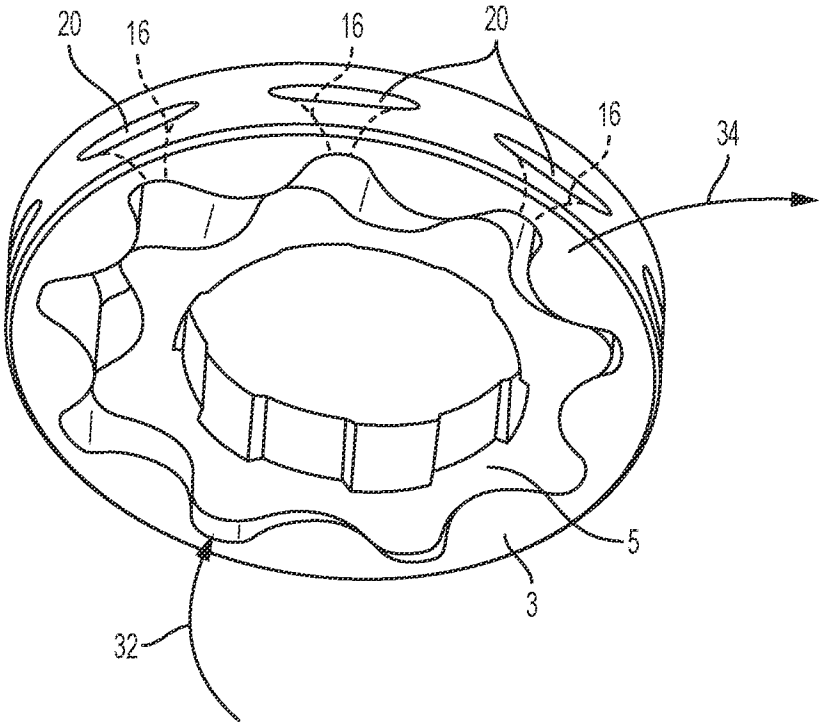
FIG. 5B is an isometric view of inner drive gear and outer driven gear according to the second embodiment of the present disclosure.
Figure 5A:
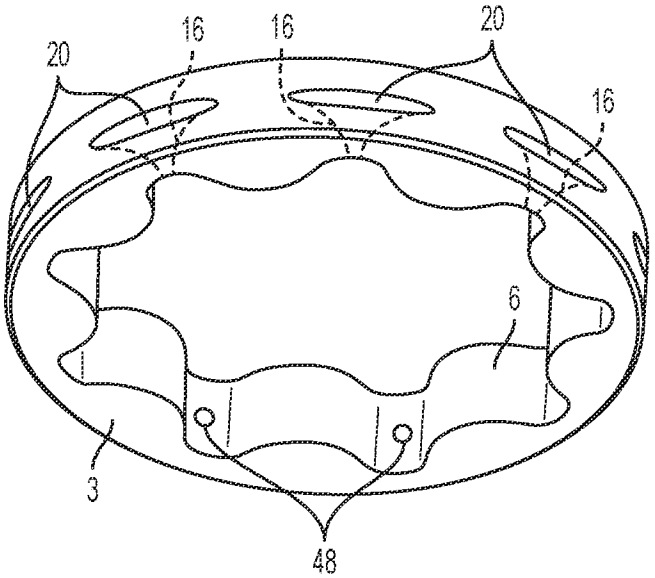
FIG. 5A is an isometric view of an outer driven gear according to a second embodiment of the present disclosure.

Referring now to FIGS. 5A and 5B, a second embodiment of the present disclosure is shown where passageways 16 are defined the outer driven gear 3. The passageways 16 begin at the inner side 6 of the outer driven gear 3 and terminate in an exterior groove 20 in the outer surface 22 of the outer driven gear 3. The exterior groove 20 may, but not necessarily be in the form of a plurality of mini-grooves 21. The exterior groove 20 or mini-grooves 21 are operatively configured to better evenly distribute scavenge oil (shown as 44 in FIG. 3) from the passageways 16 in the oil groove 7. Again, under a predetermined pressure, nominal amounts of scavenge oil 44 (shown in FIG. 3) from the cavity 12, 12' between the inner drive gear 5 and outer driven gear 3 are transferred via passageways 16 to the oil groove 7 (shown in FIG. 2). Accordingly, a hydrodynamic film 18 (shown in FIG. 2) may again be created when a predetermined maximum pressure is reached during the rotation of the inner drive gear 5 and outer driven gear 3. The scavenge oil, flows from the plurality of passageways 16 to the area between the outer driven gear 3 and housing 24 forming hydrodynamic film 18 with the excess scavenge oil subsequently flowing out of the pump outlet 11.

Figure 8:
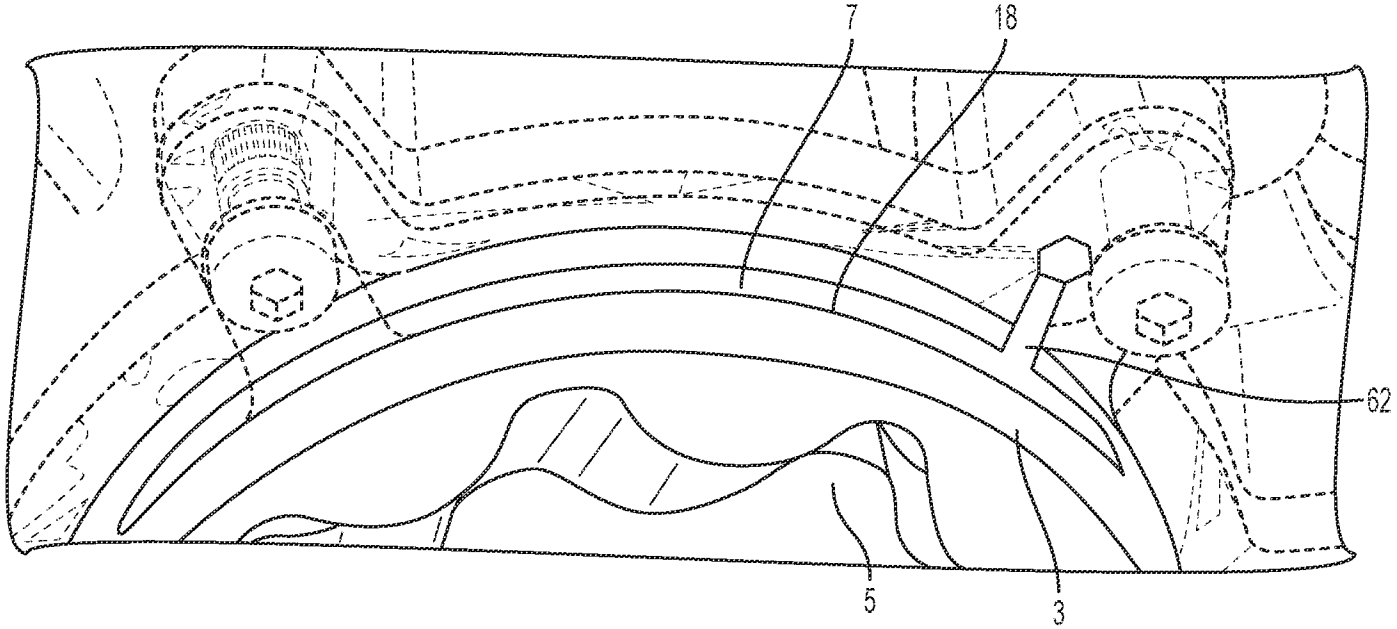
FIG. 8 is a partial perspective view of a third embodiment of the present disclosure where the oil groove is fed high pressure oil from a high pressure oil pump.

With reference to FIG. 8, a third embodiment of the present disclosure is provided where a magnified view of the housing 24 is shown. The housing 24 defines an intake port 40 which provides high pressure oil from the high pressure oil pump 60 to feed the oil groove 7 in the housing 24 thereby creating a hydrodynamic film 18 shown as 18 in FIG. 2 between the housing 24 and the outer driven gear 3. It is understood that the high pressure oil provided in the third embodiment is different from scavenge oil identified in the second embodiment given that the high pressure oil is provided by high pressure oil pump 60. The hydrodynamic film 18 may be maintained in the oil groove 7 such that the hydrodynamic film 18 is not actively purged.

While at least three exemplary embodiments have been presented in the foregoing detailed description, it should be appreciated that a vast number of variations exist. It should also be appreciated that the exemplary embodiment or exemplary embodiments are only examples, and are not intended to limit the scope, applicability, or configuration of the disclosure in any way. Rather, the foregoing detailed descriptions will provide those skilled in the art with a convenient road map for implementing the exemplary embodiment or exemplary embodiments. It should be understood that various changes can be made in the function and arrangement of elements without departing from the scope of the disclosure as set forth in the appended claims and the legal equivalents thereof.

What is claimed is:

1. A gerotor assembly comprising:

a crankshaft;

an inner drive gear mounted on the crankshaft;

an outer driven gear defining a plurality of passageways and operatively configured to engage with the inner drive gear, the outer driven gear and the inner drive gear further defining at least one compressible cavity therebetween; and a housing defining an oil groove between the housing and outer driven gear, the oil groove being in fluid communication with the at least one compressible cavity via the plurality of passageways, the oil groove having a depth of approximately 2.0 mm;

wherein the plurality of passageways begin at an inner side of the outer driven gear and terminate in a groove defined in an exterior side of the outer driven gear.

2. The gerotor assembly of claim 1 wherein the oil groove is adjacent to the exterior side of the outer driven gear.

3. The gerotor assembly of claim 1 wherein the plurality of passageways are radially aligned.

4. The gerotor assembly of claim 3 wherein the plurality of passageways each begin with an aperture in an inner side of the outer driven gear and terminate in a corresponding aperture defined in the exterior side of the outer driven gear.

5. The gerotor assembly of claim 3 wherein the plurality of passageways are operatively configured to provide increasing fluid communication between the at least one compressible cavity and an exterior surface of the outer driven gear as the compressible cavity decreases in size.

6. The gerotor assembly of claim 1 wherein the oil groove is adapted to distribute a hydrodynamic film between the outer driven gear and the housing.

7. The gerotor assembly of claim 1 wherein the gerotor assembly further includes a high pressure oil pump in fluid communication with the oil groove via a high pressure oil passage.

8. A gerotor assembly comprising:

a crankshaft;

an inner drive gear mounted on the crankshaft;

an outer driven gear defining a plurality of passageways and operatively configured to engage with the inner drive gear, the outer driven gear and the inner drive gear further defining at least one compressible cavity therebetween; and a housing defining an oil groove on an interior surface of the housing, the oil groove being in fluid communication with the at least one compressible cavity via the plurality of passageways, the oil groove having a depth of approximately 2.0 mm;

wherein the plurality of passageways begin at an inner side of the outer driven gear and terminate in a groove defined in an exterior side of the outer driven gear.

9. The gerotor assembly of claim 8 wherein the oil groove is adjacent to the exterior side of the outer driven gear.

10. The gerotor assembly of claim 8 wherein the plurality of passageways are radially aligned.

11. The gerotor assembly of claim 10 wherein the plurality of passageways each begin with an aperture in an inner side of the outer driven gear and terminate in a corresponding aperture defined in the exterior side of the outer driven gear.

12. The gerotor assembly of claim 10 wherein the plurality of passageways are operatively configured to provide increasing fluid communication between the at least one compressible cavity and an exterior surface of the outer driven gear as the at least one compressible cavity decreases in size.

13. The gerotor assembly of claim 8 wherein the oil groove is adapted to distribute a hydrodynamic film between the outer driven gear and the housing.

14. The gerotor assembly of claim 8 wherein the gerotor assembly further includes a high pressure oil pump in fluid communication with the oil groove via a high pressure oil passage.

* * * * *